US007681725B2

(12) United States Patent
Mueller et al.

(10) Patent No.: US 7,681,725 B2
(45) Date of Patent: Mar. 23, 2010

(54) CONTAINER WITH ABILITY TO TRANSFER A MATERIAL TO CONTAINER CONTENT

(75) Inventors: Joerg Mueller, Karben (DE); Yessica De Nardin, S. Giovanni Teatino Chieti (IT); Ursula Christina Glaser, Wiesbaden (DE); Robert M. Hubbard, Mason, OH (US); Lamia Delphine Mimassi, Ixelles (BE); Cornelia Schmidt, Bad Soden am Taunus (DE); Naka Seidel, Frankfurt am Main (DE)

(73) Assignee: The Procter and Gamble Company, Cincinnati, OH (US)

( * ) Notice: Subject to any disclaimer, the term of this patent is extended or adjusted under 35 U.S.C. 154(b) by 283 days.

(21) Appl. No.: 11/710,344

(22) Filed: Feb. 23, 2007

(65) Prior Publication Data

US 2008/0202953 A1 Aug. 28, 2008

(51) Int. Cl.

| | |
|---|---|
| ***B65D 81/24*** | (2006.01) |
| ***B65D 69/00*** | (2006.01) |
| ***B65H 1/00*** | (2006.01) |
| ***A24F 27/14*** | (2006.01) |

(52) U.S. Cl. ..... 206/210; 206/225; 206/229; 206/233; 221/45; 221/135

(58) Field of Classification Search ..... 206/205, 206/210, 229, 233, 494, 812, 225; 221/45, 221/135, 191, 199, 302, 303, 306; 401/40, 401/41

See application file for complete search history.

(56) References Cited

U.S. PATENT DOCUMENTS

| | | | | |
|---|---|---|---|---|
| 2,789,725 | A | 4/1957 | Carper | |
| 3,368,522 | A * | 2/1968 | Cordis | 118/43 |
| 3,749,296 | A * | 7/1973 | Harrison | 225/106 |
| 3,986,479 | A * | 10/1976 | Bonk | 118/506 |
| 4,436,224 | A * | 3/1984 | McInerny | 222/183 |
| 4,513,862 | A | 4/1985 | Mallow | |
| 4,515,909 | A | 5/1985 | Sawano et al. | |
| 4,566,606 | A * | 1/1986 | Kling | 221/25 |
| 4,759,652 | A * | 7/1988 | Ulrich | 401/196 |
| 4,761,437 | A | 8/1988 | Christie | |
| 4,849,415 | A | 7/1989 | Zweigle | |
| 4,865,221 | A | 9/1989 | Jackson et al. | |
| 5,109,029 | A | 4/1992 | Malone | |
| 5,341,992 | A | 8/1994 | Bishopp | |
| 5,582,294 | A | 12/1996 | Yamada | |

(Continued)

FOREIGN PATENT DOCUMENTS

| | | |
|---|---|---|
| EP | 0664317 A1 | 7/1995 |

(Continued)

OTHER PUBLICATIONS

PCT International Search Report.

*Primary Examiner*—Ehud Gartenberg
*Assistant Examiner*—Dene Quest
(74) *Attorney, Agent, or Firm*—Thibault Fayette

(57) ABSTRACT

A container may comprise a reservoir that may be associated with a dispensing opening or a closure element of the container. The reservoir may transfer a transferable material, such as a fragrance composition or skin health benefit ingredient, to the container's content.

11 Claims, 6 Drawing Sheets

U.S. PATENT DOCUMENTS 5,707,696 A 1/1998 Boxler
5,750,611 A 5/1998 Trouilhet
5,861,128 A 1/1999 Vick et al.
5,951,762 A * 9/1999 Shangold et al. ..... 118/405
6,059,882 A * 5/2000 Steinhardt et al. ..... 118/264
6,063,365 A 5/2000 Shefer et al.
6,170,426 B1 * 1/2001 Thorsbakken ..... 118/43
6,291,371 B1 9/2001 Shefer et al.
6,334,974 B1 1/2002 Chen
6,387,068 B1 * 5/2002 Naughton ..... 604/2
6,426,055 B1 7/2002 Shefer et al.
6,613,144 B1 * 9/2003 Loertscher et al. ..... 118/302
6,703,011 B2 3/2004 Shefer et al.
6,716,805 B1 4/2004 Sherry et al.
6,729,498 B2 * 5/2004 Yelton et al. ..... 221/63
6,902,077 B1 * 6/2005 Tack et al. ..... 220/259.1
7,018,473 B2 * 3/2006 Shadrach, III ..... 118/315
7,055,686 B2 6/2006 De-Vries
2002/0037385 A1 3/2002 Pignot et al.
2002/0086804 A1 7/2002 Shefer et al.
2002/0103086 A1 8/2002 Asrar et al.
2003/0105183 A1 6/2003 Sharak
2003/0126709 A1 7/2003 Policicchio et al.
2003/0195272 A1 10/2003 Harwell et al.
2004/0018278 A1 1/2004 Popplewell et al.
2004/0018293 A1 1/2004 Popplewell et al.
2004/0099545 A1 * 5/2004 De-Vries ..... 206/216
2004/0110648 A1 6/2004 Jordan, IV et al.
2004/0164085 A1 * 8/2004 Kitching et al. ..... 221/45
2004/0200410 A1 * 10/2004 Shadrach, III ..... 118/400
2005/0076533 A1 4/2005 Huston et al.
2005/0081888 A1 4/2005 Pung et al.
2005/0106200 A1 5/2005 Corzani et al.
2005/0125923 A1 6/2005 Benjamin et al.
2005/0129743 A1 6/2005 Benjamin et al.
2005/0139598 A1 6/2005 Tack et al.
2005/0192207 A1 9/2005 Morgan et al.
2005/0230423 A1 * 10/2005 Riney et al. ..... 222/146.2
2005/0272624 A1 12/2005 Hardy et al.
2005/0272878 A1 12/2005 Corzani et al.
2006/0177488 A1 8/2006 Caruso et al.
2006/0193985 A1 * 8/2006 McNeil et al. ..... 427/355
2006/0283731 A1 12/2006 De-Vries

FOREIGN PATENT DOCUMENTS

EP 0534600 B1 5/1996
EP 0483126 B1 3/1997
EP 0740684 B1 9/1999
EP 0985417 A2 3/2000
EP 0744357 B1 10/2000
WO WO 99/27910 6/1999
WO WO 02/066084 A1 8/2002
WO WO 2004/020566 A1 3/2004
WO WO 2005/005591 A1 1/2005

* cited by examiner

CONTAINER WITH ABILITY TO TRANSFER A MATERIAL TO CONTAINER CONTENT

FIELD

In an embodiment, the invention relates to a container. The container may comprise a reservoir. The reservoir may comprise a transferable material. The transferable material may transfer from the reservoir to the container's content upon removal from the container.

BACKGROUND

Wide varieties of consumer articles rely on fragrance compositions and skin health benefit ingredients to enhance their appeal. Lotion compositions on substrates, including wet wipes, contain many types of materials which may generally fall into the categories of fragrance compositions and skin health benefit ingredients. Challenges may arise when there is a desire to change from production of an article incorporating a particular material to an article incorporating a different material. The production line generally has to be completely shut down and thoroughly cleaned prior to introduction of the different material in order to avoid cross-contamination. This may be costly for the manufacturer as time to produce articles is lost when a production line is shut down.

Some lotion compositions may incorporate an over-dosed amount of these materials, such as fragrance compositions. Over-dosing a fragrance composition may allow the fragrance to be delivered to the skin, via the lotion, to provide an olfactory aesthetic benefit and to serve as a signal to the user that the skin is clean. The lotion composition, however, may remain on the skin for a lengthy period of time before either being absorbed by the skin or evaporating from the skin. The fragrance, therefore, also remains on the skin. While a user responds initially to the fragrance as a signal of cleanliness, the prolonged duration of the fragrance may serve as a continued reminder of the cleaning process. For example, if the user utilized the wipes in a diaper change, the initial scent of the fragrance may trigger a signal that the skin is clean. A prolonged exposure to the fragrance due to over-dosing of the fragrance in the composition, however, may continue to remind the user of the unpleasant task of the diaper change. A prolonged exposure to the fragrance may also result in olfactory adaptation in which the user becomes desensitized to the fragrance and may no longer respond to the fragrance as a signal of cleanliness.

It would be beneficial to provide a container comprising a reservoir containing transferable materials, including fragrance compositions and skin health benefit ingredients, in which the transferable materials could be transferred from the reservoir to the content of the container. It would be beneficial to provide a container comprising a reservoir for transferable materials, including fragrance compositions and skin health benefit ingredients, in which the transferable materials may be detected by the user each time the container is opened.

SUMMARY

A container comprising a container body defining an article-receiving cavity. The container body comprises a wall. The container further comprises an opening. A reservoir may be associated with the opening of the container. The article-receiving cavity comprises at least one substrate. The reservoir may comprise a transferable material, such as a fragrance composition, a skin health benefit ingredient, and combinations thereof. The transferable material may have the ability to transfer from the reservoir to the substrate.

The reservoir may comprise a hot melt adhesive. The hot melt adhesive may associate with a support base. The reservoir may comprise longitudinal openings.

A reservoir kit for use with a container, the container having a body having a wall defining an article receiving cavity, an opening within the wall, wherein the kit may comprise a first reservoir comprising a first transferable material and a second reservoir comprising a second transferable material. The first transferable material and the second transferable material may be different from each other.

DETAILED DESCRIPTION

A container may have an ability to transfer skin health benefits and fragrances compositions to its content. The transfer may occur during removal of the content from the container.

The term "extract" refers herein to an adjunct comprising the product of an extraction, mechanical separation, or combination thereof, such as, but not limited to, steam distillation, grinding, mastication, hydrolysis, aqueous extraction boiling, and combinations thereof, of a material such as a botanical or animal material. The extract may comprise a single compound or it may be a combination of compounds. The extract may be treated or further processed, such as by, but not limited to, decolorization, bleaching, deodorization, hardening or combinations thereof.

The term "flexible" means herein that the material may tend to conform or deform in the presence of externally applied forces.

The term "fragrance" refers herein to the odor of perfume, cologne or toilet water.

The term "nonwoven" refers herein to a fibrous structure made from an assembly of continuous fibers, co-extruded fibers, non-continuous fibers and combinations thereof, without weaving or knitting, by processes such as spunbonding, carding, melt-blowing, air-laying, wet-laying, co-form, or other such processes known in the art for such purposes. The nonwoven structure may comprise one or more layers of such fibrous assemblies, wherein each layer may include continuous fibers, co-extruded fibers, non-continuous fibers and combinations thereof.

The term "substrate" refers herein to a piece of material, generally nonwoven material, such as a sheet, used in cleaning or treating various surfaces, such as food, hard surfaces, inanimate objects, body parts, etc. The substrate may be wet or dry.

The term "wet" refers herein to a material, such as a nonwoven substrate, having a moisture content of greater than about 10% by weight of the material. Such materials often have a moisture content of about 50% to about 400%, 800% or more by weight of the material. This is in contrast to a "dry" material which is used herein to indicate a material having a moisture content of less than about 10% by weight of the material.

Container

A container may have any shape suitable for containing its content, such as articles such as a stack or roll of substrates. The substrates may be nonwoven. The shape may be cylindrical, spherical, polygonal or parallelepipedic.

Figure 1:
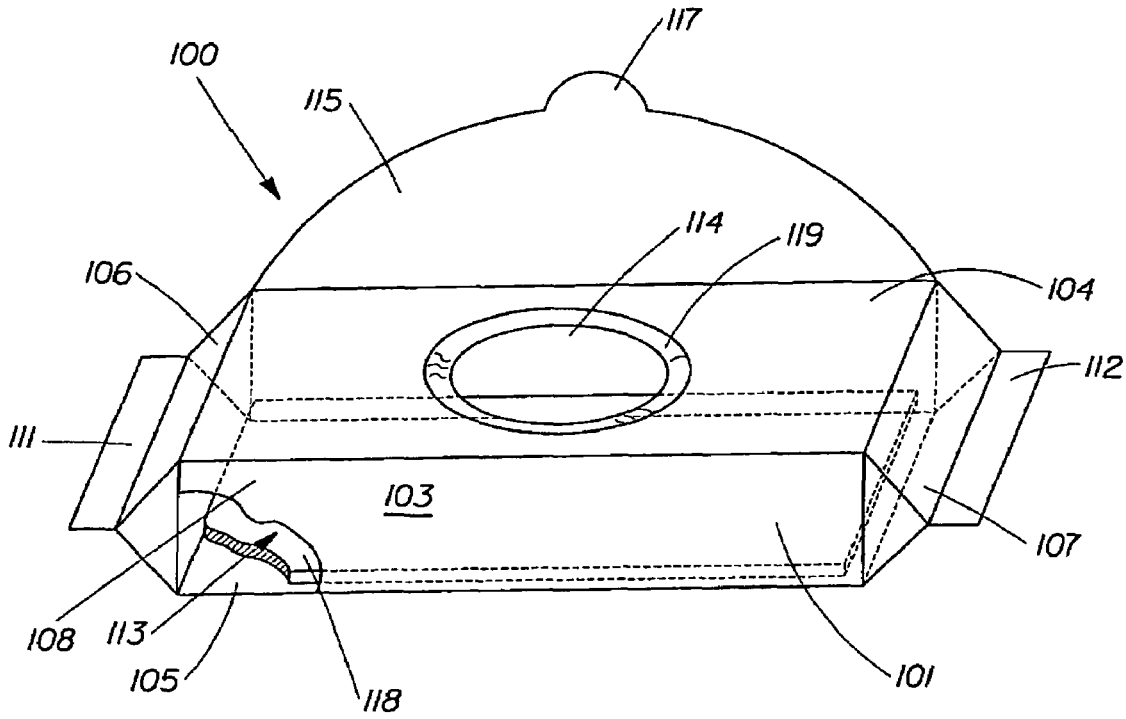
FIG. 1 is a perspective view of one embodiment of a container associated with a reservoir.

FIG. 1 illustrates one embodiment of a container 100 associated with a reservoir 119. The container 100 may comprise a body portion 101 which may be formed of flexible polymeric sheet 103. The body portion 101 may comprise walls such as a top wall 104, opposed bottom wall 105, end walls 106 and 107, and side walls 108. The container 100 may be sealed on opposing end walls 106 and 107 by end seals 111 and 112. The walls may define an article-receiving cavity 113. The container 100 may have an opening 114 in a wall. FIG. 1 illustrates placement of the opening 114 in the top wall 104. The container 100 may further comprise a closure flap 115. Alternate configurations of a closure flap 115 may be utilized and the closure flap 115 illustrated should not be considered a limiting configuration. The closure flap 115 may comprise a tab 117. The tab 117 may assist the user in the opening and closing of the closure flap 115 of the container 100. The container 100 may comprise at least one substrate 118 within the article-receiving cavity 113. The opening 114 of the container 100 may associate with a reservoir 119.

A reservoir may be source for a transferable material. Non-limiting examples of transferable materials include, but are not limited to, fragrance compositions, skin health benefit ingredients and combinations thereof. The reservoir may associate with the opening and the wall adjacent to the opening of a container such that at least a portion of the transferable material may be transferred from the reservoir to the container's content upon removal of the content from the container by a user. The association of the reservoir with the opening of the container may occur by any method including, but not limited to, adhesives, snaps, lock and key, overlapping edges, threaded grooves, male/female fasteners, and combinations thereof.

In an embodiment, the reservoir and/or the container may comprise an indicator. The indicators of the reservoir and the container may match one another. The indicator may allow a user to identify the reservoir and/or the container. The indicator may include, but is not limited to, icons, shapes, colors, contours, images, pictures, and combinations thereof. The indicator may associate with the reservoir and/or container in any manner known to one of skill in the art including, but not limited to, printing, adhesives, molding, imbuing, and combinations thereof. In an embodiment, a reservoir may comprise an indicator that may match an indicator comprised by a container. In such an embodiment, the match may be identical. Some non-limiting examples may include, a reservoir may comprise the color purple and a container may comprise the color purple; a reservoir may comprise the color teal and a container may comprise the color teal; a reservoir may comprise a water drop icon and a container may comprise a water drop icon; a reservoir may comprise a paw-shape and a container may comprise a paw-shape icon; and a reservoir may comprise a heart-shape and a container may comprise a heart-shape icon.

In an embodiment, a reservoir may comprise an indicator that may correspond with an indicator comprised by a container. In such an embodiment, the correspondence may be such that the indicator comprised by the reservoir may relate to the indicator comprised by the container but they need not be an identical match. Some non-limiting examples may include, a container may comprise an animal image and a reservoir may comprise a paw-shape icon in which the paw-shape icon of the reservoir would be the paw print made by the animal of the container; a reservoir may comprise a water drop icon and a container may comprise an image of a body of water.

In an embodiment, the reservoir may be permanently attached and/or integrated to the container. The reservoir may be removable from the container. Removal of the reservoir may occur by undoing the mechanism by which the reservoir is associated with the container. Thus, the reservoir may be interchangeable with an alternate reservoir. A first reservoir may comprise a first transferable material and a second reservoir may comprise an identical transferable material as the first reservoir. In an embodiment, the second reservoir may comprise a second transferable material that is different from the first transferable material. For example, the first reservoir may comprise a first fragrance composition and the second reservoir may comprise a second fragrance composition wherein the first and second fragrance compositions are noticeably different to the user. A user may desire such an interchangeability as the user may coordinate the transferable material to their task. For example, if the removable content within the container is a body surface cleaning substrate, such as for a baby, the user may desire a citrus fragrance composition in the morning to stimulate the child and a lavender fragrance composition in the evening to calm a child on its way to sleep. As another example, if the removable content is a household surface cleaning substrate, the user may desire a citrus fragrance composition in the kitchen and a rose fragrance composition in a bathroom.

In an embodiment, the reservoir may be substantially colorless. In an embodiment, the reservoir may comprise at least one pigment. The pigment may coordinate with a transferable material. Without being bound by theory, it is believed that a coordinating pigment may provide a signal to the user as to the type of transferable material associated with the reservoir. A few non-limiting examples of such coordination may include a reservoir comprising a purple pigment and a lavender fragrance composition; a pink pigment and rose fragrance composition; and an orange pigment and citrus fragrance composition. As the reservoir may be removable from the container, a reservoir comprising a first pigment and a first transferable material may be exchanged for a reservoir comprising a second pigment and a second transferable material.

Figure 2:
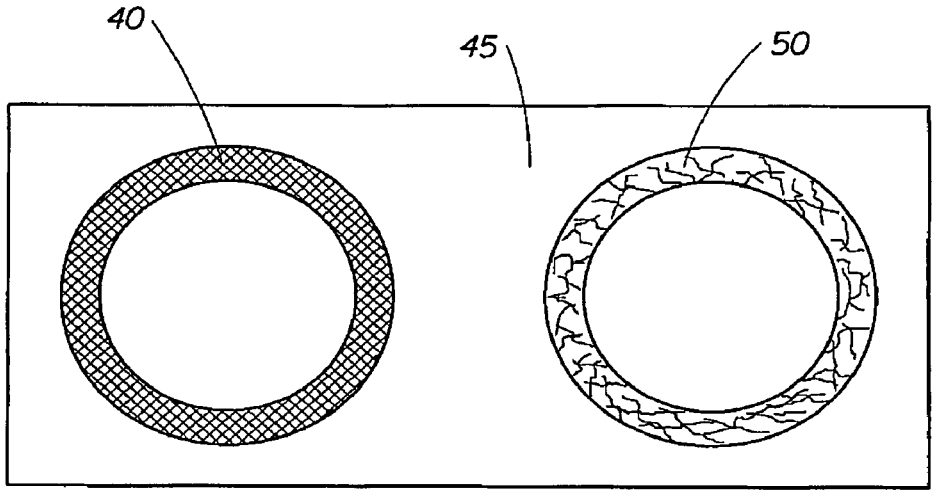
FIG. 2 is a top view of an embodiment in which two reservoirs may be packaged together in a kit.

Multiple reservoirs may be packaged together into a kit and may comprise identical transferable materials or may comprise alternative transferable materials from each other. In an embodiment, multiple reservoirs may be packaged together into a kit in which a first reservoir comprises a first pigment and a first transferable material and a second reservoir comprises a second pigment and a second transferable material. The first and second transferable material may differ from each other. FIG. 2 is a non-limiting example of an embodiment of two reservoirs, 40 and 50, packaged together in a kit 45. The first reservoir 40 may comprise a first pigment and a first transferable material, as illustrated by hatchmarks. The second reservoir 50 may comprise a second pigment and a second transferable material as indicated by wavy lines. In an embodiment, the first pigment and second pigment may be identical, such as pink, and the first transferable material and the second transferable material may be identical, such as a rose fragrance composition. In an embodiment, the first pigment may be different from the second pigment, such as the first pigment may be pink and the second pigment may be purple, and the first transferable material may be different from the second transferable material, such as the first transferable material may be a rose fragrance composition and the second transferable material may be a lavender fragrance composition. Reservoirs 40 and 50 are illustrated as arranged side by side in the kit 45. It should be recognized that the reservoirs may be packaged in a multitude of arranges. Some non-limiting examples of arrangements may include packaging the reservoirs individually and the individual packages arranged together to form a kit, at least two reservoirs may be packaged together in a kit, at least two reservoirs comprising different transferable materials may be packaged together in a kit, the reservoirs may be packaged one behind another and/or side by side.

The reservoir may be made from or at least comprise cardboard, corrugated paper, wood, cardstock, thermoplastic material, non-thermoplastic material, paper, ceramic, thermosetting polymers and combinations thereof. The reservoir may comprise a thermoplastic material. For example, the reservoir may comprise polypropylene, polyethylene, high density polyethylene, and combinations thereof.

As container content, such as a substrate, is removed from the container it may contact the reservoir. The contact between the container content and the reservoir may result in a transfer of an effective amount of transferable materials from the reservoir to the content. For example, an effective amount may be considered to be any amount that when transferred from the reservoir to the container content, either when the content is removed from the container or at least a portion of the container content contacts at least a portion of the reservoir, may provide the intended benefit of the transferable material such as a smell or a skin health benefit. The transferable materials may transfer from the reservoir to the content by any mechanism, such as, but not limited to, rubbing, friction, dissolution, wicking, and combinations thereof. The transferable materials may include, but are not limited to, fragrance compositions, skin health benefit ingredients or combinations thereof.

In an embodiment, the reservoir may comprise a hot melt adhesive. The hot melt adhesive may be associated with a support base comprising materials, such as, but not limited to, those materials described above for the reservoir. The support base may provide a structure for the hot melt adhesive in order to enable the hot melt adhesive to associate with the container. A support base may also facilitate the interchangeability of the reservoir. The hot melt adhesive may comprise a copolymer of ethylene with at least another monomer comprising at least one heteroatom and a plasticizer, or mixture of plasticizers, comprising at least one heteroatom.

The hot melt adhesive may comprise the copolymer of ethylene with at least another monomer comprising at least one heteroatom in an amount from about 5% or 10% to about 50% or 75% by weight of the hot melt adhesive. All copolymers of ethylene with at least another monomer comprising at least one heteroatom are suitable for use herein. The term "monomer comprising at least one heteroatom" may include monomers which comprise at least a C—X linkage wherein X is not C or H. Said C—X linkage may be a polar linkage. The carbon atom may be linked to an N, S, F, Cl or O atom. The polar linkage may be part of a carbonyl group or of an ester group. Monomers comprising at least one heteroatom may include, but are not limited to, vinyl acetate, vinyl alcohol, methyl acrylate, ethyl acrylate, butyl acrylate, acrylic acid and salts formed therefrom, methacrylic acid and salts formed therefrom, maleic anhydride, glycidyl methacrylate and carbon monoxide. The monomer comprising at least one heteroatom may represent from about 10% to about 90% of the total weight of the copolymer.

Copolymers may include, but are not limited to, block and non-block copolymers, grafted copolymers, copolymers with side chains, crosslinked copolymers and copolymers where ethylene monomers may be randomly copolymerized with monomers comprising at least one heteroatom. Copolymers of ethylene may include, but are not limited to, ethylene-vinyl acetate copolymers, ethylene-vinyl ester copolymers, ethylene-acrylic ester copolymers, ethylene-methacrylic ester copolymers, ionomers, ethylene-acrylic acid copolymers, ethylene-methacrylic acid copolymers, ethylene-vinyl ester-acrylic acid copolymers, ethylene-vinyl ester-methacrylic acid copolymers, ethylene-vinyl ester-maleic anhydride copolymers, ethylene-acrylic ester-maleic anhydride copolymers, ethylene-vinyl ester-glycidyl methacrylate copolymers, ethylene-acrylic ester-glycidyl methacrylate copolymers, ethylene-maleic anhydride copolymers, and ethylene-glycidyl methacrylate copolymers.

The hot melt adhesive may comprise the plasticizer comprising at least one heteroatom in an amount from about 5%, 10% or 15% to about 40% or 60% by weight of the hot melt adhesive. The plasticizer may be compatible with the copolymer of ethylene with at least another monomer comprising at least one heteroatom. The term "plasticizer comprising at least one heteroatom" may include all those plasticizers which comprise at least a C—X linkage in the molecule wherein X is not C or H. Said C—X linkage may be a polar linkage. The carbon atom may be linked to an N, S, F, Cl or O atom. The polar linkage may be part of a carbonyl group or of an ester group.

The plasticizers may include, but are not limited to, citric acid esters, low molecular weight polyesters, polyethers, liquid rosin esters, aromatic sulfonamides, phthalates, benzoates, sucrose esters, derivatives of polyfunctional alcohols (where polyfunctional means having 2 or more hydroxyl groups), adipates, tartrates, sebacates, esters of phosphoric acid, fatty acids and diacids, fatty alcohols and diols, epoxidized vegetable oils and mixtures thereof.

In an embodiment, the reservoir may comprise at least one cavity. The cavity may provide a storage location for the transferable materials. The transferable materials may be located on the surface of the reservoir, in the cavity of the reservoir or combinations thereof.

Figure 3:
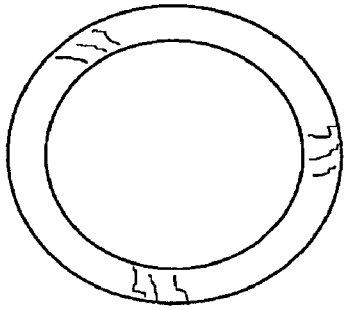
FIG. 3 is a top view of a reservoir in a circular shape.

The reservoir may have any shape deemed suitable by one of skill in the art. In an embodiment, the reservoir may comprise substantially the same shape as the opening of the container. In an embodiment, the shape of the reservoir may differ from the shape of the opening of the container. Non-limiting examples of shapes of the reservoir may include, but are not limited to, circle, oval, square, rectangle, triangle, elliptical, bar, semi-circle, semi-oval, semi-elliptical, semi-square, semi-rectangle, semi-triangle, undulating curvature, and combinations thereof. FIG. 3 illustrates a reservoir whose inner and outer edges have a circular shape.

The reservoir may comprise inner and outer edges. The inner edge may define the size and shape of the innermost boundary of the reservoir. The inner edge may be of a sufficient circumference to align with the opening of the container. In an embodiment, the circumference of the inner edge may be smaller than the circumference of the opening of the container. In such an embodiment, the inner edge may extend over the opening of the container. Without being bound by theory, it is believed that an inner edge extending over the opening of the container may increase the opportunity for the content of the container to contact the reservoir as it is being removed from the container, thereby increasing the ability to transfer the transferable materials from the reservoir to the container content. The outer edge may define the size and shape of the outermost boundary of the reservoir. The outer edge of the reservoir may be of a sufficient dimension to be larger than the dimension of the opening of the container such that at least a portion of the reservoir may "rest" on the wall which comprises the opening. The resting of the reservoir on the wall may decrease the likelihood of the reservoir falling through the opening. Without being bound by theory, it is believed that an outer edge extending beyond the opening of the container may provide the reservoir with a large contact surface area. A larger contact surface area may enable the reservoir to remain in contact with the container during removal of the content and may diminish the possibility of the reservoir lifting up from the container.

Figure 4:
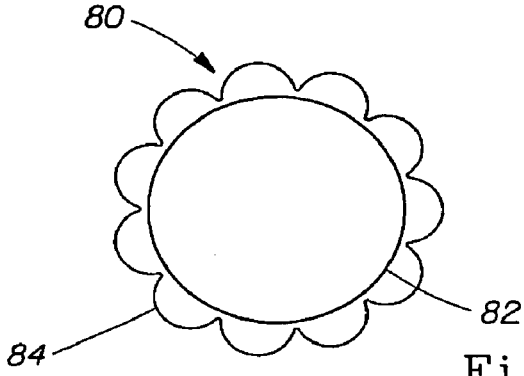
FIG. 4 is a top view of a reservoir with an inner edge comprising a circular shape and an outer edge comprising an arcuate shape.
Figure 5:
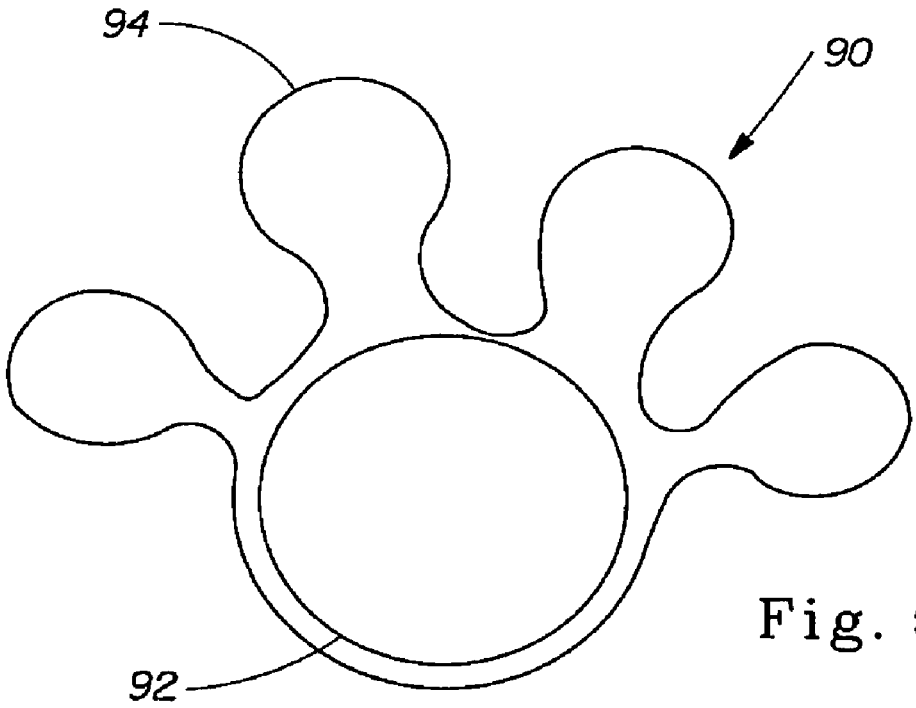
FIG. 5 is a top view of a reservoir with an inner edge comprising a circular shape and an outer edge comprising a paw print shape.

In an embodiment, the inner and outer edges may comprise identical shapes. In such an embodiment, the shapes of the inner and outer edges may be identical, but need not be identical, to the shape of the opening of the container. A non-limiting example may be that both the inner and outer edges have a circular shape. In an embodiment, the inner and outer edges may comprise non-identical shapes. FIG. 4 illustrates a non-limiting example of a reservoir 80 in which the inner edge 82 comprises a circular shape and the outer edge 84 has an arcuate shape. FIG. 5 illustrates a non-limiting example of a reservoir 90 in which the inner edge 92 comprises a circular shape and the outer edge 94 comprises a shape in the image of a paw print. The paw print may be any paw print deemed suitable by one of skill. Without being bound by theory, it is believed that a paw print may serve as an instructional indicator for a user, such as a pre-literate child, as to where the user may grasp the content of the container to remove it from the container. This may allow the user to perform a personal hygiene task. The paw print of the reservoir may be complimentary to any other instructional and/or educational indicia on the container as well as any other "touch here" indicators that may be present on the container. For example, a container may comprise instructional indicia illustrations with iconic images of the steps of personal bathroom hygiene for a pre-literate child. The indicia may include anthropomorphic images to engage the child's attention such as by giving human characteristics to a non-human entity such as, but not limited to, an animal. The container may comprise a push button comprising an image of a paw print that may indicate the location where a child should touch in order to open the container. A reservoir comprising the shape of a paw print may further carry the education by indicating the location where the child should place their hands next in order to remove content, such as a substrate, from the container. It should be realized that any aesthetically pleasing shape may be contemplated for the shape of the reservoir.

Figure 6:
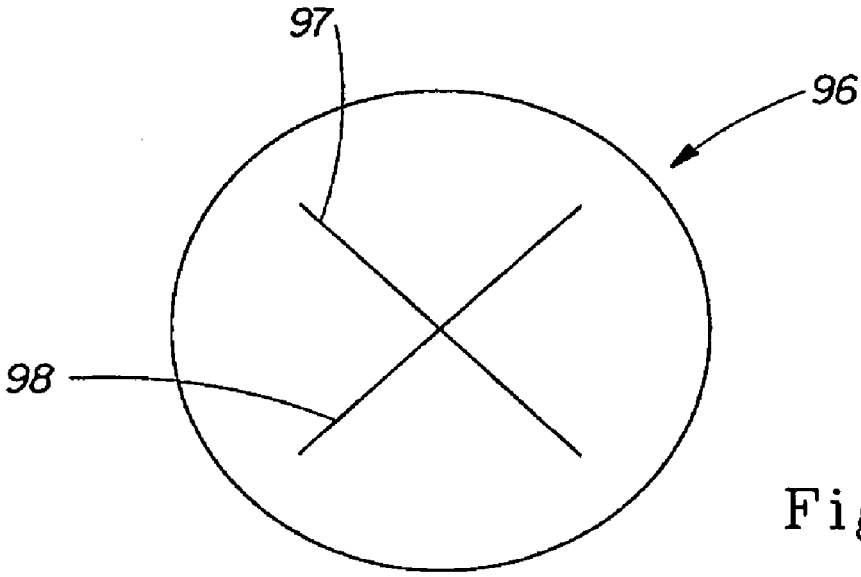
FIG. 6 is a top view of a reservoir comprising two longitudinal openings in a bi-secting configuration.

In an embodiment, the reservoir may comprise a disc shape. In such a shape, the reservoir may comprise a substantially longitudinal opening such as a cut or slit to allow the user to reach through the reservoir to remove content from the container. Segments of the longitudinal openings may be, but are not limited to, straight, wavy, arcuate and combinations thereof. The reservoir may comprise at least one longitudinal opening. The reservoir may be flexible. Without being bound by theory, the flexibility may enable the reservoir to deflect as a user reaches through the longitudinal opening to grasp content, such as a substrate, within the container and removed from the container. The reservoir may comprise from about 1, 2, 3, 4, or 5 to about 6, 7, 8, 9, or 10 longitudinal openings. Without being bound by theory, it is believed that an increase in the number of longitudinal openings may create substantially "pie shaped sections" and may facilitate the ease with which a user may reach through the opening and remove content from the container. An increase in the number of longitudinal openings in combination with flexibility of the reservoir may further increase the ease for removing content from the container. It is also believed that an increase in the number of longitudinal openings may provide for an increase in contact areas over which the content may be pulled. It is believed that an increase in contact areas may increase the amount of transferable material that may be transferred from the reservoir to the content. FIG. 6 illustrates a reservoir 96 comprising two longitudinal openings, 97 and 98, in a bisecting configuration.

Figure 7:
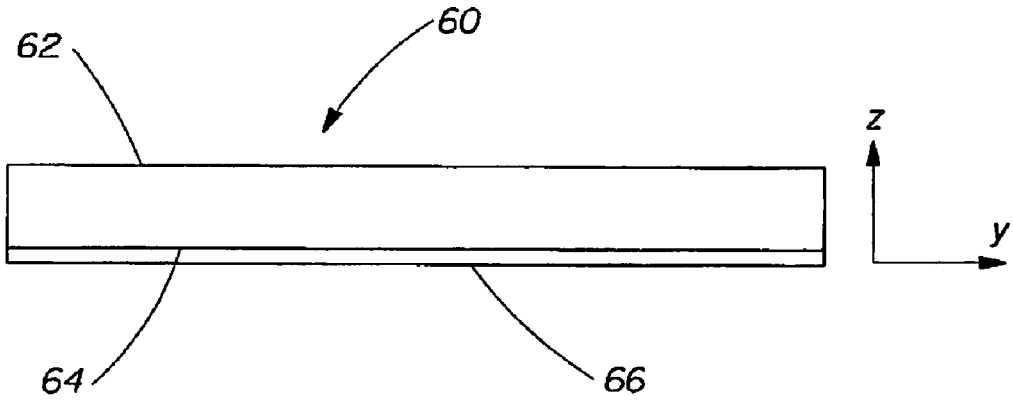
FIG. 7 is a side view of a reservoir having a uniform thickness.
Figure 8:
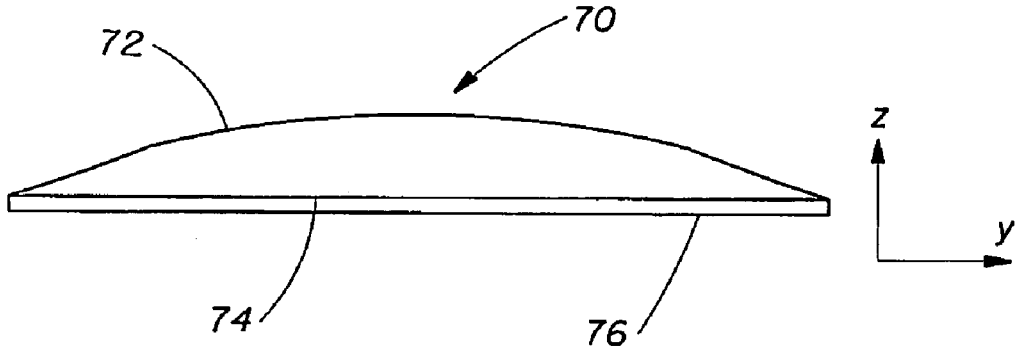
FIG. 8 is a side view of a reservoir having a varying thickness.

In an embodiment, the reservoir may have a thickness in the Z direction as measured from the top edge of the reservoir to the bottom edge of the reservoir. The thickness of the reservoir may be uniform throughout the reservoir or the thickness may vary. The reservoir may be substantially flat or may comprise a variation in thickness. The variation in thickness may provide for a reservoir that has a substantially dome shape or a reservoir in which the thickness may vary across the width of the reservoir. The reservoir may comprise a thickness in the Z-direction from about 0.5, 1, 1.5, 2, 2.5, 3, 3.5, 4, 4.5 or 5 mm to about 5.5, 6, 6.5, 7, 7.5, 8, 8.5, 9, 9.5 or 10 mm. The reservoir may comprise a thickness of about least about 0.5 mm. FIG. 7 illustrates a side view of an embodiment of a reservoir 60 comprising a uniform thickness in the Z-direction between the top edge 62 and the bottom edge 64 of the reservoir 60. The reservoir 60 may comprise a support base 66. FIG. 8 illustrates a side view of a reservoir 70 comprising a varying thickness in the Z-direction between the top edge 72 and the bottom edge 74 of the reservoir 70. The reservoir 70 may comprise a support base 76. The thickness of the reservoir may affect the flexibility of the reservoir. Without being bound by theory, it is believed that a thin reservoir may be more flexible and a thick reservoir may be less flexible. The flexibility of the reservoir may vary as the thickness of the reservoir may vary. In an embodiment, the reservoir may comprise a uniform thickness and may comprise a uniform flexibility. In an embodiment, the reservoir may comprise a varying thickness and may comprise a varying flexibility. In an embodiment, the reservoir may comprise a disc shape and may exhibit an increased flexibility at the center of the disc than the flexibility exhibited at the outer edges of the disc.

The thickness of the reservoir, as well as the width as defined by the outer edge, may supplement a closure flap or lid in the closing and sealing of a container. The reservoir may fill any void space that may exist between the wall of the container and the closure flap or lid. It should be recognized that the reservoir need not be of a size so as to fill any void space. It should also be recognized that the reservoir need not be of a size so as to prevent or interfere with the closure of the container. In an embodiment, multiple reservoirs may be stacked together in an association with the container. In such an embodiment, the reservoirs may comprise identical or different transferable materials to each other. A user may pick and choose the desired combination of reservoirs to stack in order to deliver a user desired combination of chosen fragrance compositions and skin health benefit ingredients. The stack of reservoirs may combine together to create an overall thickness which may not interfere with the closing and/or sealing of the container.

The reservoir may comprise a transferable material such as a fragrance composition. The fragrance composition may comprise components including, but not limited to, benzenoid materials, alcohol materials, ester materials, aldehyde materials, ketone materials, natural materials, aromatherapy adjuvants, and mixtures thereof. The materials may be found in "Perfume and Flavor Chemicals", Vol. I and II, S. Arctander, Allured Publishing, 1994, ISBN 0-931710-35-5. The fragrance components may be employed at levels of from about 0.001%, 0.01%, 0.1%, 0.5%, or 1% to about 2%, 4%, 5%, or 10% by weight of the fragrance composition. The reservoir may comprise the fragrance composition in an amount of more than about 5%, 10%, 20%, 30%, 40% or 50% by weight of the reservoir. The fragrance composition may comprise less than about 80% or 90% by weight of the reservoir. The reservoir may comprise about 50% of fragrance composition by weight of the reservoir.

The benzenoid materials may include, but are not limited to, benzyl benzoate, benzyl carbinol, benzyl salicylate, benzyl cinnamate, diethyl phthalate, phenoxy ethanol, hexahydro-4,6,6,7,8,8-hexamethylcyclopenta-γ-2-benzopyran, 7-acetyl-1,1,3,4,4,6-hexamethyltetralin, 3-(3,4-methylene dioxyphenol)-2-methyl propanol, methyl-iso-eugenol, eugenol, and mixtures thereof.

The alcohol materials may include, but are not limited to, citronellol, alcohol C-8, alcohol C-10; alcohol C-11, alcohol C12, dipropylene glycol, linalool, geraniol, benzyl alcohol, 2-ethyl-4-(2,2,3-trimethyl-3-cyclopentene-1-yl)-2-buten-1-ol, dihydromyrcenol, and mixtures thereof.

Aldehydes may include, but are not limited to, C6-C14 aliphatic aldehydes, C6-C14 acyclic terpene aldehydes, and mixtures thereof. The aldehydes may be selected from C8-C12 aliphatic aldehydes, C8-C12 acyclic terpene aldehydes and mixtures thereof. The aldehydes may include, but are not limited to, citral; neral; iso-citral; dihydro citral; citronellal; octanal; nonanal; decanal; undecanal; dodecanal; tridecanal; 2-methyl decanal; methyl nonyl acetaldehyde; 2-nonenal; undecenal; undecylenic aldehyde; 2,6 dimethyl octanal; 2,6,3,10, trimethyl undecen-1-al; trimethyl undecanal; dodecenal; melonal; 2-methyl octanal; 3,5,5, trimethyl hexanal and mixtures thereof. The aldehyde materials may be selected from 4-(4-hydroxy-4-methylpentyl)-3-cyclohexene 1-carboxoaldehyde, p-t-butyl-α-methyldihydrocinnamic aldehyde, aldehyde C-10, aldehyde C-11, aldehyde C-12, laurinal, heliotropine, anisic aldehyde, benzyl aldehyde, and mixtures thereof.

The ester materials may include, but are not limited to, benzyl acetate, dimethyl benzyl carbinyl acetate, ethylene brassylate, cyclopentadecanolide, linalyl acetate, benzyl proprionate, citronellyl acetate, hexyl butyrate, neryl acetate, prenyl acetate, hexyl cinnamate, oxacyclohexadecen-2-one, and mixtures thereof.

The ketone materials may include, but are not limited to, methyl ionone, ambretone, methyl dihydro jasmonate, muscone, allyl ionone, and mixtures thereof.

The fragrance composition may comprise natural materials such as, but not limited to, aloe, apple, avocado, berry, calendula, chamomile, clovetree oil, coconut, eucalyptus, grapefruit, green tea, guava, honey, jojoba, kiwi, lavender, lemon, lemongrass, lime, mango, melon, milk, mint, orange, papaya, peach, pineapple, rose water, rosemary, sage, sandalwood, sunflower, sweet almond oil, tea tree oil, thyme, vanilla, vitamin C, vitamin E, zinc oxide and combinations thereof.

The fragrance composition may comprise an aromatherapy adjuvant, including but not limited to, Anise Oil, Balm Mint Oil, Basil Oil, Bay Oil, Bee Balm Oil, Bergamot Oil, Cabbage Rose Oil, *Calendula Officinalis* Oil, Cardamon Oil, Cedarwood Oil, Chamomile Oil, Cinnamon Oil, Citronella Oil, Coriander Oil, Cypress Oil, *Eucalyptus Citriodora* Oil, *Eucalyptus Globulus* Oil, Gardenia Florida Oil, *Geranium Maculatum* Oil, Jasmine Oil, Lavender Oil, Lovage Oil, Mandarin Orange Oil, Musk Rose Oil, Myrrh Oil, Orange Flower Oil, Orange Oil, Passionflower Oil, Rosemary Oil, Rose Oil, Rose Hips Oil, Rosewood Oil, Sage Oil, Sweet Marjoram Oil, Sweet Violet Oil, Tea Tree Oil, Thyme Oil, and combinations thereof. Additional aromatherapy oils may be found in US Publication No. 2005/0125923 by Benjamin et al.

The reservoir may comprise a transferable material such as a skin health benefit ingredient. The skin health benefit ingredient may comprise an extract such as, but not limited to, botanical extracts, sterols, animal extracts and combinations thereof. The reservoir may comprise the skin health benefit ingredient in an amount of more than about 5%, 10%, 20%, 30%, 40% or 50% by weight of the reservoir. The skin health benefit ingredient may comprise less than about 80% or 90% by weight of the reservoir. The reservoir may comprise about 50% of skin health benefit ingredient by weight of the reservoir.

Examples of botanical extracts may include natural blends of fatty acids which mimic those found in the stratum corneum and mixtures of fatty acids with pigments such as carotenes, carotenoids or phytosterols. Some examples of botanical extracts may include, but are not limited to, avocado, carrot, which contains beta-carotene; sesame oil which contains a mixture of saturated and unsaturated fatty acids, sesame seed oil, and brazil nut oil.

A sterol or sterol derivative may be any suitable sterol, such as but not limited to, one or more of the group consisting of: β-sterols having a tail on the 17 position and having no polar groups, for example cholesterol, sitosterol, stigmasterol, and ergosterol, as well as, $C_{10}$-$C_{30}$ cholesterol/lanosterol esters, cholecalciferol, cholesteryl hydroxystearate, cholesteryl isostearate, cholesteryl stearate, 7-dehydrocholesterol, dihydrocholesterol, dihydrocholesteryl octyidecanoate, dihydrolanosterol, dihydrolanosteryl octyidecanoate, ergocalciferol, tall oil sterol, soy sterol acetate, lanasterol, soy sterol, avocado sterols, cholesterol esters, sterol esters, avocadin and lanolin.

Additional details on skin health benefit ingredients may be found in US Publication No. 2005/0129743 by Benjamin et al.

The transferable material may be distinct from the other elements of the reservoir, and as such, the transferable material may be heterogeneously distributed in the reservoir. In this instance, the transferable material may comprise a liquid within an otherwise solid reservoir, and the reservoir may resemble a spray-bottle, roller-applicator, or other mechanism by which the distinct transferable material may be transferred to the substrate.

Alternately, the transferable material may be co-mingled with the other elements of the reservoir, and as such, may be homogeneously distributed throughout the reservoir. In the instance where the transferable material/reservoir "complex" may comprise a saturated sponge, impregnated zeolite, lattice clathrate, imbued plastic or other form. Without being bound by theory, it is believed that, in the instance where the transferable material is homogeneously distributed throughout the reservoir, the transferable material is transferred to the substrate by virtue of diffusion, within the reservoir to its surface, and subsequent contact-transfer to the substrate, at the surface of the reservoir, with the substrate is contacted to the reservoir surface. An example of such an embodiment in which the transferable material may be homogenously distributed throughout the reservoir may include, but is not limited to, a reservoir comprising a hot melt adhesive.

Figure 9:
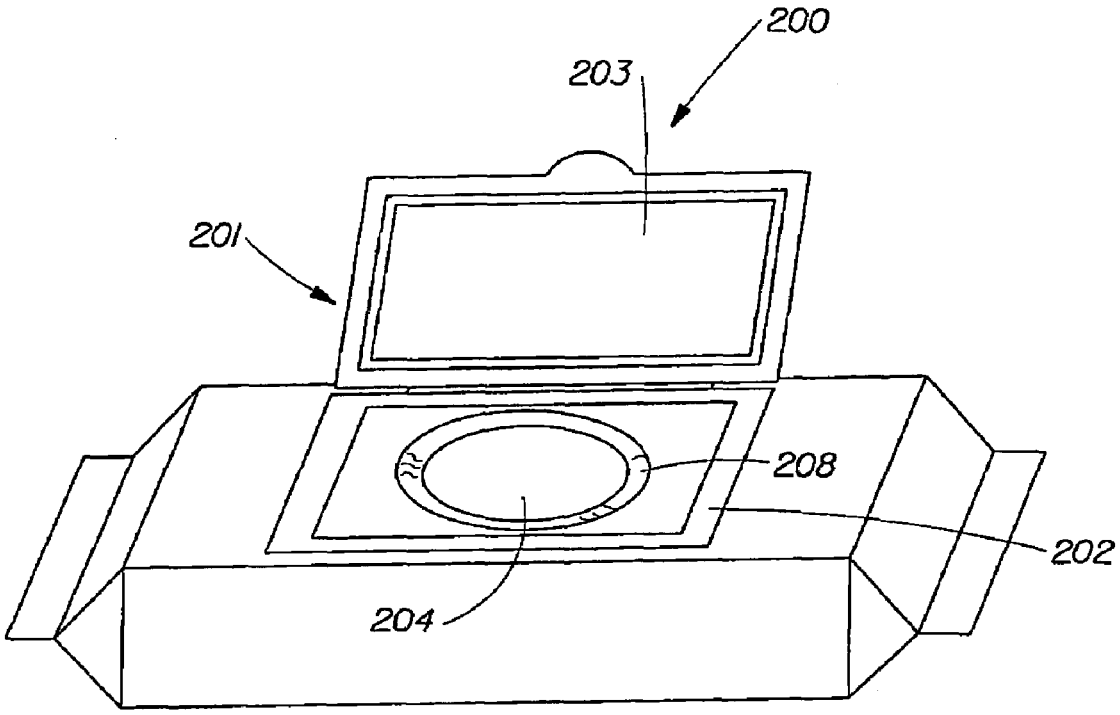
FIG. 9 is a perspective view of an alternate embodiment of a container associated with a reservoir.

FIG. 9 illustrates an alternate embodiment of a container 200 which may be fitted with a closure element 201. The closure element 201 may comprise a first portion 202 and a second portion 203 that may be hinged together in any known manner, including, but not limited to, spring elements, elastically deformable elements, weakened elements, etc, and combinations thereof. The closure element 201 may comprise any shape deemed suitable by one of skill in the art. The first portion 202 may be positioned around the opening 204 of the container 200. The closure element 201 may associate with the container 200 in any suitable manner known to one of skill, including, but not limited to, adhesive, heat seal, stitching, and any combination thereof. The second portion 203 of the closure element 201 may interact with the first portion 202 in any manner known to one of skill in order to place the container 200 in a closed configuration. A reservoir 208 may associate with the closure element 201 and/or the opening 204 of the container 200. The association of the reservoir 208 with the closure element 201 of the container 200 may occur by any method including, but not limited to, adhesives, snaps, lock and key, overlapping edges, threaded grooves, male/female fasteners, and combinations thereof. As illustrated in FIG. 9, the reservoir 208 is smaller than the first portion 202 of the closure element 201. It should be recognized that the reservoir 208 may be the same size as the first portion 202 of the closure element 201. The second portion 203 of the closure element 201 may cover the opening 204 and the reservoir 208 when the container 200 is in a closed configuration. In an embodiment, the closure element may comprise the reservoir. In such an embodiment, at least a portion of the closure element may comprise the reservoir.

Figure 10:
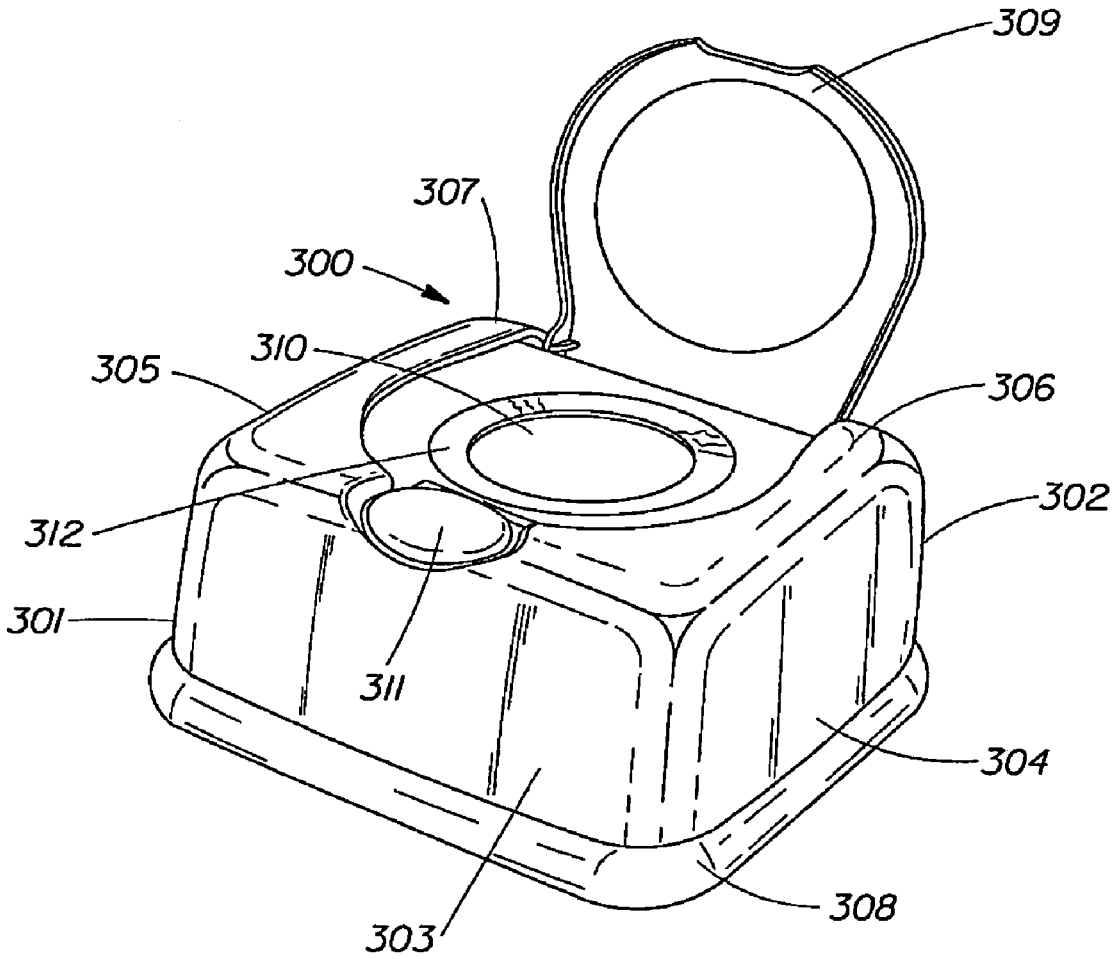
FIG. 10 is a perspective view of an alternate embodiment of a container associated with a reservoir.

FIG. 10 illustrates an alternate embodiment of a container 300 comprising a container body 301. The container body 301 may comprise back 302, front 303, right 304 and left 305 walls. A stationary cover 306 may be integrally molded with the container body 301, such as to form a top wall 307, and the bottom of the container may be open so as to constitute a refill opening. A removable, and optionally flexible, cover 308 may be fitted onto the refill opening. A moveable lid 309 may be associated with the stationary cover 306 and may cover a dispensing opening 310. The container 300 may further comprise a push button 311. A reservoir 312 may associate with the opening 310 of the container 300.

The container may be molded from a polypropylene material or any other suitable thermoplastic materials such as polyethylene, polystyrene, acrylonitryl butadiene styrene (ABS), polyester, polyvinyl chloride, polycarbonate or elastomer, or a blend of these compounds. Additional details of the description of containers may be found in U.S. Pat. No. 6,902,077 issued to Tack et al., Jun. 7, 2005 and US Publication No. 2005/0139598 by Tack et al., Jun. 30, 2005.

Substrate

The content of the container may be any consumer article. The content may be any article such as substrates for body care or household cleaning purposes. The substrate may be a nonwoven material. The substrate may be wet or dry. The fibers of the substrate may be any natural, cellulosic, and/or synthetic material such as polymeric material. The natural fibers may be treated or otherwise modified mechanically or chemically to provide desired characteristics or may be in a form that is generally similar to the form in which they can be found in nature. Any or all of the synthetic fibers may be treated before, during, or after manufacture to change any desired properties of the fibers.

In certain embodiments, it may be desirable to have particular combinations of fibers to provide desired characteristics. For example, it may be desirable to have fibers of certain lengths, widths, coarseness or other characteristics combined in certain layers or separate from each other. The fibers may be of virtually any size and preferably have an average length from about 1 mm to about 60 mm. Average fiber length refers to the length of the individual fibers if straightened out. The fibers may have an average fiber width of greater than about 5 micrometers. The fibers may have an average fiber width of from about 5 micrometers to about 50 micrometers. The fibers may have a coarseness of greater than about 5 mg/100 m. The fibers may have a coarseness of from about 5 mg/100 m to about 75 mg/100 m.

The fibers may be circular in cross-section, dog-bone shape, delta (i.e., triangular cross section), trilobal, ribbon, or other shapes typically produced as staple fibers. Likewise, the fibers can be conjugate fibers such as bicomponent fibers. The fibers may be crimped and may have a finish, such as a lubricant, applied.

The substrate materials may be treated to improve the softness and texture thereof. The substrate may be subjected to various treatments, such as, but not limited to, physical treatment, such as ring rolling, structural elongation, consolidation, stretch aperturing, differential elongation, and other solid state formation technologies, and zone activation; chemical treatment, such as, but not limited to, rendering part or all of the substrate hydrophobic and/or hydrophilic; thermal treatment, such as, but not limited to, softening of fibers by heating and thermal bonding; and combinations thereof.

The substrate may have a basis weight between about 15, 30, 40, 45, 65, 75, or 100 grams/$m^2$ and about 200, 300, 400 or 500 grams/$m^2$. A suitable substrate may be a carded nonwoven comprising a 40/60 blend of viscose fibers and polypropylene fibers having a basis weight of 58 grams/$m^2$ as available from Suominen of Tampere, Finland as FIBRELLA™ 3160. FIBRELLA™ 3160 is a 58 grams/$m^2$ nonwoven web comprising 60% w/w 1.5 denier polypropylene fibers and 40% w/w 1.5 denier viscose fibers. Another suitable material may be FIBRELLA™ 3100 which is a 62 grams/$m^2$ nonwoven web comprising 50% w/w 1.5 denier polypropylene fibers and 50% w/w 1.5 denier viscose fibers. In both of these commercially available fibrous webs, the average fiber length is about 38 mm. Another suitable material for use as a substrate may be SAWATEX™ 2642 as available from Sandier AG of Schwarzenbach/Salle, Germany. Yet another suitable material for use as a substrate may have a basis weight of from about 50 grams/$m^2$ to about 60 grams/$m^2$ and have a 20/80 blend of viscose fibers and polypropylene fibers. The substrate may be a 60/40 blend of pulp and viscose fibers.

Substrates may be generally of sufficient dimension to allow for convenient handling. Typically, the substrate may be cut and/or folded to such dimensions as part of the manufacturing process. In some instances, the substrate may be cut into individual portions so as to provide separate wipes which are often stacked and interleaved in consumer packaging. In other embodiments, the substrates may be in a web form where the web has been slit and folded to a predetermined width and provided with means (e.g., perforations) to allow individual wipes to be separated from the web by a user. An individual substrate may have a length between about 100 mm and about 300 mm and a width between about 100 mm and about 250 mm. In one embodiment, the substrate may be about 200 mm long and about 180 mm wide.

In one embodiment, the surface of substrate may be essentially flat. In another embodiment, the surface of the substrate may contain raised and/or lowered portions. These can be in the form of logos, indicia, trademarks, geometric patterns, images of the surfaces that the substrate is intended to clean (i.e., infant's body, face, etc.). They may be randomly arranged on the surface of the substrate or be in a repetitive pattern. In another embodiment, the substrate may be biodegradable. For example the substrate may comprise a biodegradable material such as a polyesteramide, or a high wet strength cellulose.

Composition

The substrate may associate with a composition. The composition may generally comprise the following optional materials: emollients, surfactants, rheology modifiers, preservatives, or a combination of preservative compounds acting together as a preservative system and water. Other materials may be incorporated into the composition, including, but not limited to, soothing agents, vitamins, minerals, antioxidants, moisturizers, botanicals, fragrances, potentiators, aesthetic enhancing ingredients, texturizers, colorants, medically active ingredients, such as healing actives and skin protectants and additional skin health benefit ingredients. It is to be noted that some materials can have a multiple function and that all materials are not necessarily present in the composition. The composition may be an oil-in-water emulsion. The pH of the composition may be from about pH 3, 4 or 5 to about pH 7, 7.5, or 9. The composition may have a water content level of greater than about 50%, 60%, 70% or 85%. The composition may have a water content less than about 25%, 15%, or 10% for use with a primarily dry substrate.

Emollients may include silicone oils, functionalized silicone oils, hydrocarbon oils, fatty alcohols, fatty alcohol ethers, fatty acids, esters of monobasic and/or dibasic and/or tribasic and/or polybasic carboxylic acids with mono and polyhydric alcohols, polyoxyethylenes, polyoxypropylenes, mixtures of polyoxyethylene and polyoxypropylene ethers of fatty alcohols, and mixtures thereof. The emollients may be either saturated or unsaturated, have an aliphatic character and be straight or branched chained or contain alicyclic or aromatic rings. An example of an emollient is caprylic capric triglycerides in combination with Bis-PEG/PPG-16/16 PEG/PPG-16/16 dimethicone known as ABIL CARE™ 85 (available from Degussa Care Specialties of Hopewell, Va.). Emollients, when present, may be used at a weight/weight % (w/w) of the composition from about 0.5%, 1% or 4% to about 0.001%, 0.01%, or 0.02% w/w.

The surfactant can be an individual surfactant or a mixture of surfactants. The surfactant may be a polymeric surfactant or a non-polymeric one. The surfactant may be employed as an emulsifier. The surfactant, when present, may be employed in an amount effective to emulsify the emollient and any other non-water-soluble oils that may be present in the composition, such as an amount ranging from about 0.5%, 1%, or 4% w/w to about 0.001%, 0.01% or 0.02% w/w (based on the weight surfactant over the weight of the composition).

The composition may include one or more surfactants. The surfactant or combinations of surfactants may be mild, which means that the surfactants provide sufficient cleansing or detersive benefits but do not overly dry or otherwise harm or damage the skin. The surfactant may include those selected from the group consisting of anionic surfactants, nonionic surfactants, cationic surfactants, amphoteric surfactants, zwitterionic surfactants, and mixtures thereof.

Examples of rheology modifiers include, but are not limited to, Ultrez™-10, a carbomer, and Pemulen™ TR-2, an acrylate crosspolymer, both of which are available from Noveon, Cleveland Ohio, and Keltrol™, a Xanthan gum, available from CP Kelco, San Diego Calif., and combinations thereof. Rheology modifiers, when present, may be used at a weight/weight % (w/w) of the composition from about 0.01%, 0.015%, or 0.02% to about 1%, 2% or 3%.

The lotion composition may comprise a preservative or a combination of preservatives acting together as a preservative system. A preservative may be understood to be a chemical or natural compound or a combination of compounds reducing the growth of microorganisms. Materials useful as preservatives include, but are not limited to: methylol compounds, iodopropynyl compounds, simple aromatic alcohols, paraben compounds, chelators such as ethylenediamine tetraacetic acid, and combinations thereof.

The composition may comprise a fragrance. The fragrance may be the same as the fragrance composition comprised by the reservoir. In another embodiment, the fragrance may be different from the fragrance composition comprised by the reservoir. In such an embodiment, the fragrance composition comprised by the reservoir and the fragrance comprised by the composition may be complimentary. In an embodiment, the fragrance comprised by the composition may be a lasting fragrance and may provide an aesthetically pleasing smell and the fragrance composition comprised by the reservoir may be an initial fragrance and may provide an initial signal of cleanliness.

Additional details on the substrate and composition may be found in U.S. Pat. No. 6,716,805 issued to Sherry et al.; US Publication Nos. 2003/0126709 by Policicchio et al., 2005/0081888 by Pung et al., and 2006/0177488 by Caruso et al.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

a. a container body comprising walls, said walls defining an article-receiving cavity and including a top wall;

b. said top wall comprising an opening with a circumference;

c. at least one substrate within said article-receiving cavity;

d. a reservoir having an outer edge with a circumference and a reservoir opening in communication with said opening in said top wall, wherein the circumference of said outer edge is greater than the circumference of said opening such that a portion of said reservoir rests on said top wall, said reservoir comprising a support base and a hot melt adhesive applied to said support base, said hot melt adhesive comprising a transferable material wherein said transferable material is chosen from at least one of a fragrance composition and a skin health benefit ingredient, wherein at least some of said transferable material transfers from said reservoir to said substrate upon removal of said substrate from said container.

2. The container of claim 1 wherein said reservoir transfers an effective amount of said transferable material to said substrate.

3. The container of claim 1 wherein said transferable material is homogenously distributed throughout said reservoir.

4. The container of claim 1 wherein said reservoir comprises at least one longitudinal opening.

5. The container of claim 1 wherein said reservoir is removable from said top wall.

6. The container of claim 1 wherein said container further comprises a closure element.

7. The container of claim 6 wherein said closure element comprises first and second portions, wherein said first portion is positioned around said opening and wherein said second portion covers said opening and said reservoir when the container is in a closed configuration.

8. The container of claim 1 wherein said substrate further comprises a composition.

9. The container of claim 8 wherein said composition comprises a fragrance and wherein said transferable material comprises a fragrance composition which is complimentary to said fragrance of said composition.

10. The container of claim 1 wherein said substrate is a body surface cleansing wipe.

11. The container of claim 1 wherein said substrate is a hard surface cleansing wipe.

* * * * *